US006438846B1

(12) United States Patent
Alsaifi

(10) Patent No.: US 6,438,846 B1
(45) Date of Patent: Aug. 27, 2002

(54) DISPOSABLE THREE BLADE STRAIGHT RAZOR

(76) Inventor: Saad Mobarak Alsaifi, P.O. Box 232, Al Fentas (KW)

( * ) Notice: Subject to any disclaimer, the term of this patent is extended or adjusted under 35 U.S.C. 154(b) by 0 days.

(21) Appl. No.: 09/484,892

(22) Filed: Jan. 18, 2000

(30) Foreign Application Priority Data

Nov. 7, 1999 (EG) ..... 1398/99

(51) Int. Cl.[7] ..... B26B 21/06; B26B 21/10
(52) U.S. Cl. ..... 30/53; 30/50
(58) Field of Search ..... 30/30, 32, 50, 30/47, 53, 54, 528

(56) References Cited

U.S. PATENT DOCUMENTS 1,137,976 A * 5/1915 Hyde ..... 30/53
1,450,859 A * 4/1923 Kulhawy ..... 30/32
2,817,897 A * 12/1957 Meohas ..... 30/53
2,952,910 A * 9/1960 Meohas ..... 30/53
3,255,523 A * 6/1966 Robertson et al. ..... 30/53
4,622,742 A 11/1986 Lee
4,920,644 A 5/1990 LaGattuta
5,009,003 A * 4/1991 Grange ..... 30/53
5,343,622 A * 9/1994 Andrews ..... 30/50
5,649,364 A 7/1997 Ilanlou
6,082,007 A * 7/2000 Andrews ..... 30/50

FOREIGN PATENT DOCUMENTS

FR 2 704 797 * 10/1994

* cited by examiner

*Primary Examiner*—Hwei-Siu Payer
(74) *Attorney, Agent, or Firm*—Thomas R. Vigil; Welsh & Katz, Ltd.

(57) ABSTRACT

The disposable straight razor comprises: an elongate body; a triple razor blade assembly mounted in the body; the body being molded about the triple razor blade assembly; the triple razor blade assembly extending outwardly from the body a distance of from approximately 0.5 mm to approximately 4 mm; and a cover for the body and the triple razor blade assembly which extends over the body and completely over the triple razor blade assembly.

20 Claims, 4 Drawing Sheets

DISPOSABLE THREE BLADE STRAIGHT RAZOR

BACKGROUND OF THE INVENTION

1. Field of the Invention

The present invention relates to a disposable straight razor having three razor blades for use in barber shops and by hairdressers.

2. Description of the Prior Art

Presently available shaving devices and, razor blades used therein typically include a body and a razor blade which is periodically changed while keeping the body of the device for further use.

The shaving device of this type is exposed to various contamination factors during the process of changing blades such as may result from any wounds that might have taken place during the prior shaving use.

This can lead to the contamination of the shaving device per se, which in turn can cause infection and may cause the transfer of different diseases from one infected person to another healthy person. Infections are now very serious and include skin diseases in addition to the more serious diseases, which are carried by skin and blood, such as staphococus, hepatitis Virus B and C and AIDS.

Heretofore, several disposable straight razors have been proposed, and examples of same are disclosed in the following U.S. Patents.

| U.S. Pat. No. | Patentee |
|---|---|
| 4,622,742 | Lee |
| 4,920,644 | LaGattuta |
| 5,649,364 | Ilanlou |

SUMMARY OF THE INVENTION

An object or feature of the present invention is to provide a disposable straight razor having at least three blades for shaving which is light weight and easy to use in barber shops and by hairdressers.

Another object or feature of the present invention is to provide a disposable straight razor having a body molded about at least three razors blades for shaving with a high safety factor that ensures non transmission of diseases and microbes from one infected person to another healthy person together together with a smooth shave in an easy and safe manner.

Another object of the invention is to provide a disposable straight razor having at least three razor blades fixed in a body which does not need blade replacement or changing and accordingly does not need to be touched by the user whereby infections are not transmitted to the user himself.

Still another object of the present invention is to provide a disposable straight razor having at least three razor blades for fine shaving which is effected twice first by a middle blade and then by one of two outer blades thereby to provide a very fine shaving.

According to the teachings of the present invention there is provided a disposable straight razor comprising: an elongate body; a triple razor blade assembly mounted in the body; the body being molded about the triple razor blade assembly; the triple razor blade assembly extending outwardly from the body a distance of from approximately 0.05 mm to approximately 4 mm; and a cover for the body and the triple razor blade assembly which extends over the body and completely over the triple razor blade assembly.

DESCRIPTION OF THE PREFERRED EMBODIMENT(S)

Figure 1:
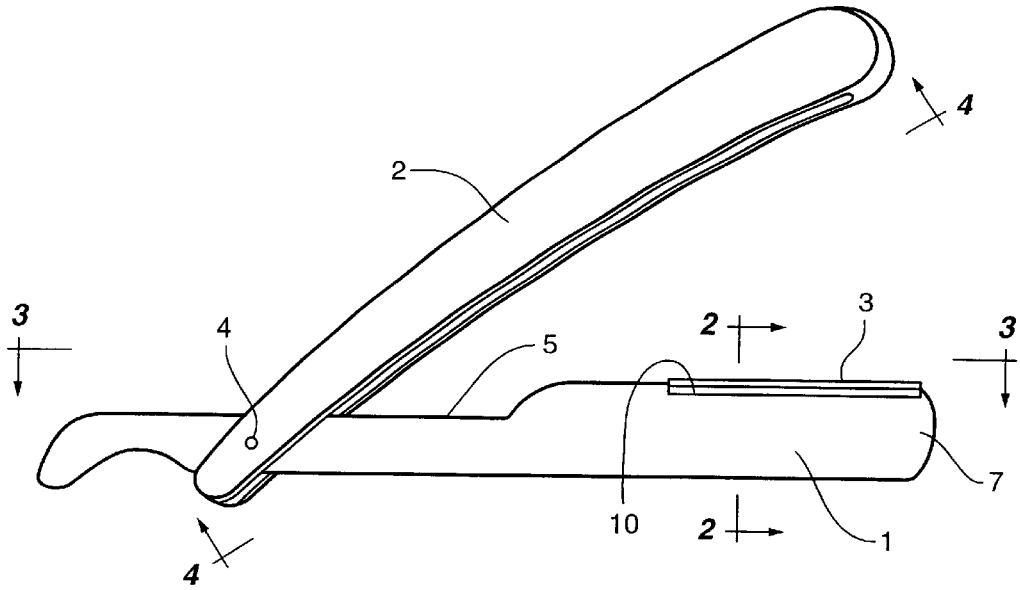
FIG. 1 is a plan view of one embodiment of the disposable straight razor of the present invention.

In FIG. 1 there is illustrated a plan view of a disposable straight razor 1 constructed according to the teachings of the present invention. The disposable triple edge straight razor 1 comprises two sections, the first section being a body 7 of the straight razor 1 with a triple razor blade assembly 3 fixed therein, and the second section being a cover 2 for the disposable straight razor 1 which is coupled to the body 7 and can act as a balance for the straight razor 1 when it is held in a user's hand. The two sections 2 and 7 are connected by a screw 4 which can be made from any suitable material, e.g., a plastic or a metal.

It should be noted that a syurface 5 of the disposable straight razor is rough or serrated and is not smooth in order to prevent sliding of the disposable straight razor in the hand of the user and to allow maximum control of the straight razor during use to get the best shaving result in the shortest possible time.

Figure 2:
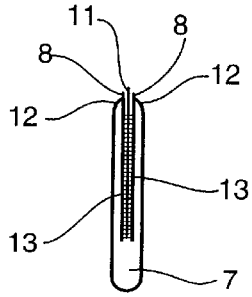
FIG. 2 is a sectional view through the body of the disposable straight razor shown in FIG. 1 and is taken along line 2—2 of FIG. 1.

FIG. 2 is a cross-section of the body 7 and the triple razor blade assembly 3 shown in FIG. 1. The triple blade razor assembly 3 is fixed in the body 7 so that it cannot be detached or removed or replaced. The triple razor blade assembly 3 comprises a higher or upper blade 11 and two lower, outer blades 12. There is a space 8 between the upper edge of the blade 11 and each one of the lower outer blades 12 with spacing material 13 between the higher blade 11 and a first one of the lower blades 12 and between the higher blade 11 and the other lower blade 12. The distance between the two outer blades is between approximately 1 mm and approximately 4 mm. Also, each lower blade 12 can have the body 7 molded up to the upper edge of the lower, outer blade 12 as shown in FIG. 2 and the upper edge even can be a smooth continuation of the side of the body 7.

Figure 3:
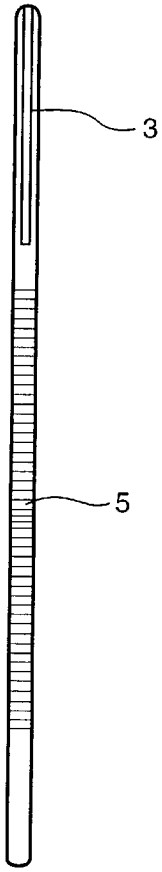
FIG. 3 is a top plan view of the body of the disposable straight razor shown in FIG. 1 and is taken along line 3—3 of FIG. 1.

FIG. 3 is a top plan view of the body 7 of the disposable straight razor 1 shown in FIG. 1 and shows the triple razor blade assembly 3 with the three blades 11 and 12 and the rought or serrated surface 5 on an upper edge of the body 7 adjacent the triple razor blade assembly 3 mounted in the body 7.

It is to be noted that the triple razor blade assembly 3 is fixed in the body 7 of the disposable straight razor 1 so that it cannot be detached or removed and so that the upper blade 11 projects above an upper edge 10 of the body 7 by approximately 0.5 mm to approximately 4 mm, and preferably between 1 and 2 mm for providing smooth fine shaving. The higher or upper blade 11 projects between approximately 0.5 mm and approximately 2 mm above the lower, outer blades 12. The distance between the blade 11 and each one of the lower blades 12 is in the range of between approximately 0.5 mm and approximately 2 mm and is maintained by the normally plastic, spacing material 13 on each side of the higher blade 11.

Figure 4:
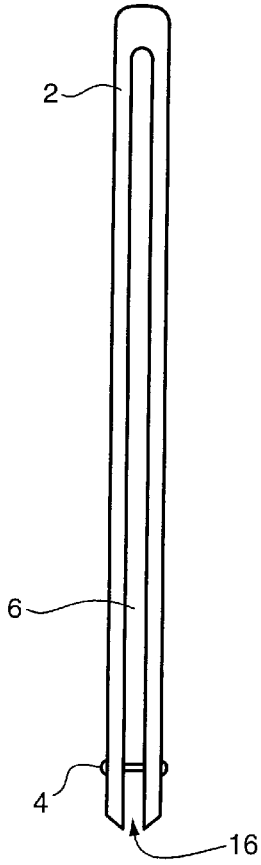
FIG. 4 is bottom plan view of the cover for the disposable straight razor shown in FIG. 1 and is taken long line 4—4 of FIG. 1.

FIG. 4 is a bottom or underside view of the cover 2 and show a slot or cavity 16 which receives the triple blade assembly and at least part of the body 7 of the disposable straight razor 1 and shows the position of the screw 4 forming a pivot axis for the cover 2 and a cover stopper rod 6 which extends across the cover 2 and serves to stop movement of the cover 2 against the body 7 of the disposable razor 1.

The cover 2 serves to cover the triple razor blade assembly 3 and serves as a handle to facilitate the use of the disposable straight razor 1.

Figure 5:
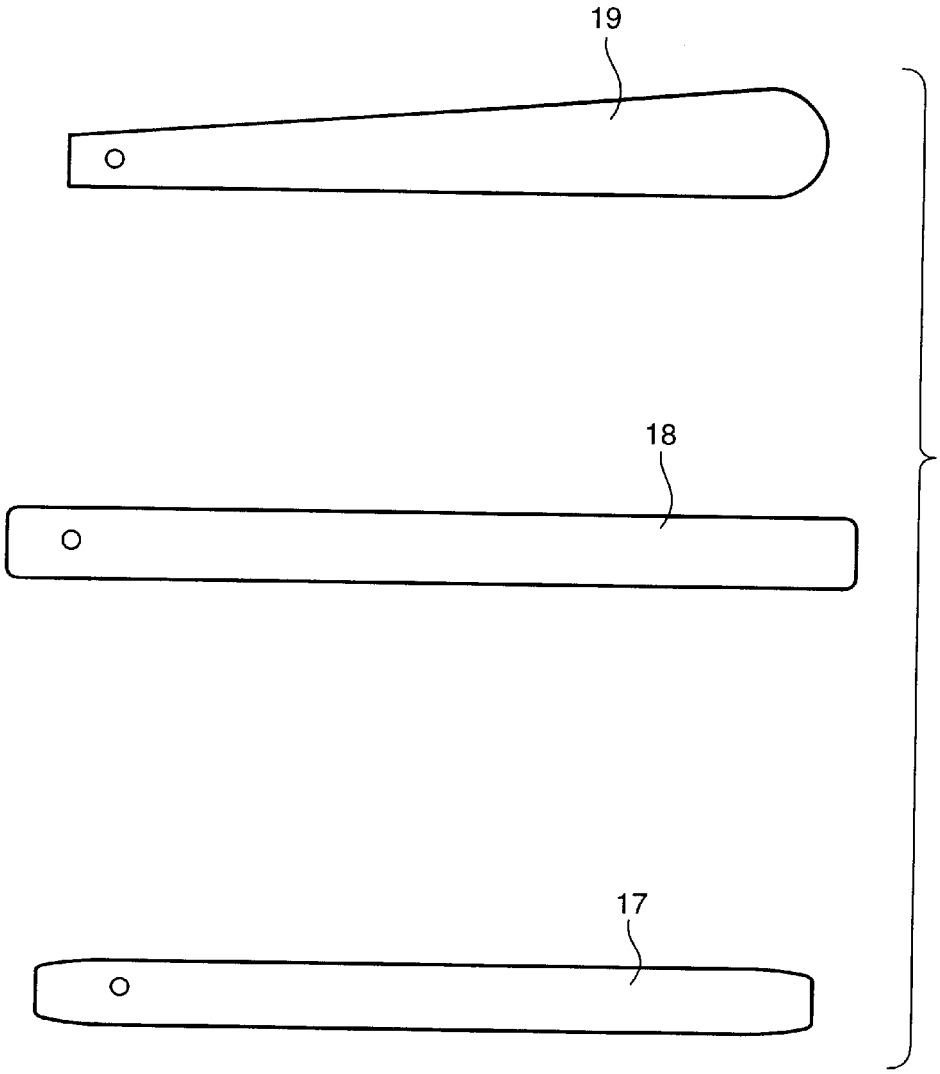
FIG. 5 illustrates three shapes of the cover or handle extension for the straight razor shown in FIG. 1.

As shown in FIG. 5, the cover 2 may have any shape other than the shape shown in FIG. 1, e.g. the shapes 17, 18 and 19 shown in FIG. 5, although the shape of the cover 2 is not to be limited to the shapes shown in the drawings.

Figure 6:
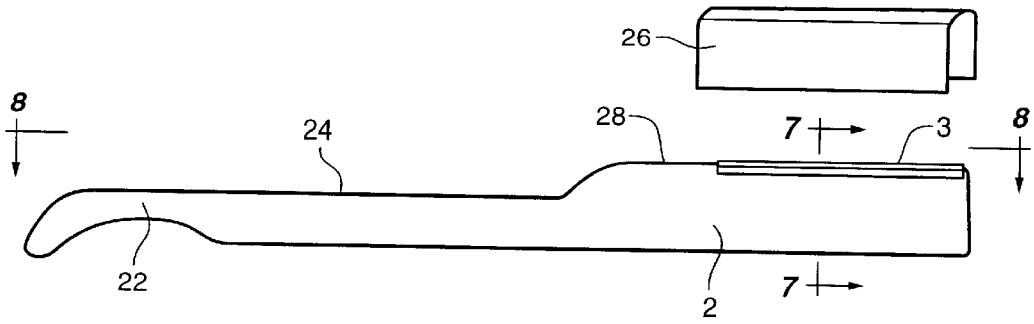
FIG. 6 is a plan view of another embodiment of the disposable straight razor of the present invention.

FIG. 6 illustrates another embodiment of a straight razor 21 of the present invention. In this embodiment, a curved razor handle 22 is integral with a body 24 having a triple razor blade assembly 3 mounted in the body 24. In this embodiment, a separate, plastic, elongate, inverted U-shaped cover 26 is provided which is not connected to the body 24. Here the straight razor 21 and the triple razor blade assembly 3 mounted in the body 24 of the straight razor 21 are one simple piece easy to handle and use with a disposable plastic cover 26.

It is to be noted that the triple razor blade assembly 3 is fixed in the body 24 of the disposable straight razor 21 so that it cannot be detached or removed and so that the upper blade 11 projects above an upper edge 28 of the body 24 by approximately 0.5 mm to approximately 4 mm, and preferably between 1 and 2 mm for providing smooth fine shaving. The higher or upper blade 11 projects between approximately 0.5 mm and approximately 2 mm above the lower, outer blade 12 by 0.5–2 mm . The distance between the higher blade 11 and each one of the lower blades 12 is in the range of between approximately 0.5 mm and approximately 2 mm and is maintained by the normally plastic, spacing material 13.

Figure 7:
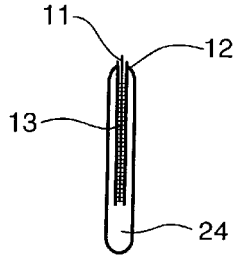
FIG. 7 is a sectional view through the body of the disposable straight razor shown in FIG. 6 and is taken along line 7—7 of FIG. 6.

FIG. 7 is a sectional view of the body 24 shown in FIG. 6 and is similar to the sectional view shown in FIG. 2 and shows the body 24, the triple razor blade assembly 3, the higher or upper blade 11, the lower outer blades 12 and the spacing material 13.

Figure 8:
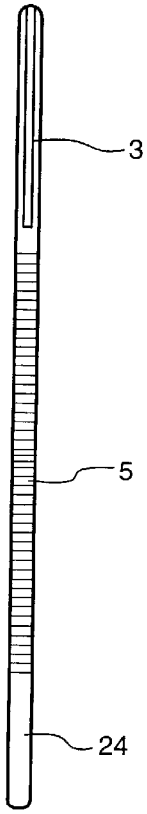
FIG. 8 is a top plan view of the body of the disposable straight razor shown in FIG. 6 and is taken along line 8—8 of FIG. 6.
Figure 9:
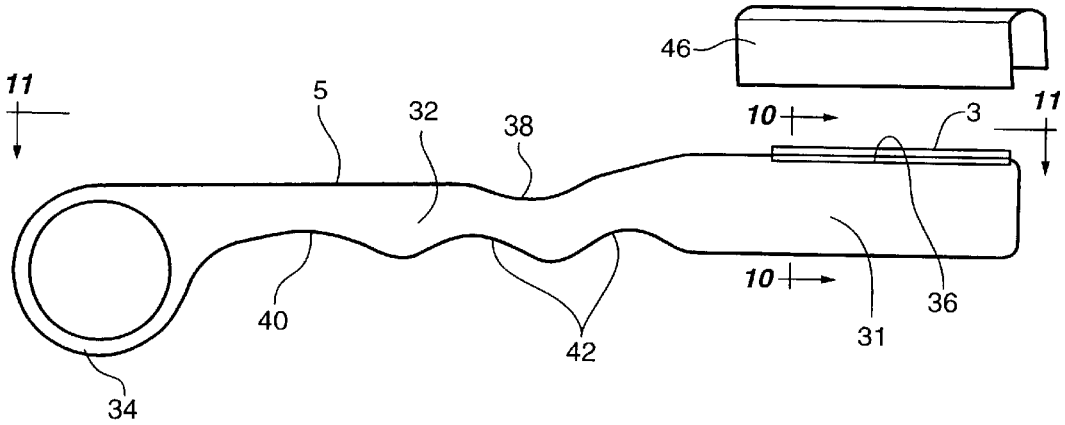
FIG. 9 is a plan view of still another embodiment of the straight razor of the present invention

FIG. 8 is a top plan view of the body 24 shown in FIG. 6 and is similar to the top plan view shown in FIG. 3 and shows the triple razor blade assembly 3 and the rough or serrated surface 5;

FIG. 9 illustrates still another embodiment of a straight razor 31 having a body 32 constructed according to the teachings of the present invention. The straight razor 31 represents a slight variation of the straight razor 21 shown in FIG. 6. In this respect, the variation resides in the shape of the body 32 of the straight razor 31 which has a ring shaped handle portion 34 and an upper edge 36 having the triple razor blade assembly 3 mounted therein and having a notch 38 for receiving a finger or thumb. Also, a lower edge 40 of the body 32 has finger receiving notches 42 for facilitating gripping of the body 32 and handle portion 34. The triple razor blade assembly 3 is identical to the triple razor blade assembly 3 shown in FIGS. 1, 6 and 9 and the simple plastic cover 46 is identical to the cover 26 shown in FIG. 6.

It is to be noted that the triple razor blade assembly 3 is fixed in the body 32 of the disposable straight razor 31 so that it cannot be detached or removed and so that the upper blade 11 projects above an upper edge 36 of the body 32 by approximately 0.5 mm to approximately 4 mm, and preferably between 1 and 2 mm for providing smooth fine shaving. The higher or upper blade 11 projects between approximately 0.5 mm and approximately 2 mm above the lower, outer blade 12 by 0.5–2 mm . The distance between the higher blade 11 and each one of the lower blades 12 is in the range of between approximately 0.5 mm and approximately 2 mm and is maintained by the normally plastic, spacing material 13 on each side of the higher blade 11.

Figure 10:
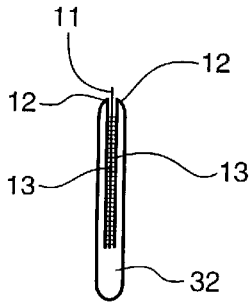
FIG. 10 is a sectional view through the body of the disposable straight razor shown in FIG. 9 and is taken along line 10—10 of FIG. 9.

FIG. 10 is a sectional view of the body 32 shown in FIG. 9 and is similar to the sectional view shown in FIG. 2 and shows the body 32, the triple razor blade assembly 3, the higher or upper blade 11, the lower outer blades 12 and the spacing material 13.

Figure 11:
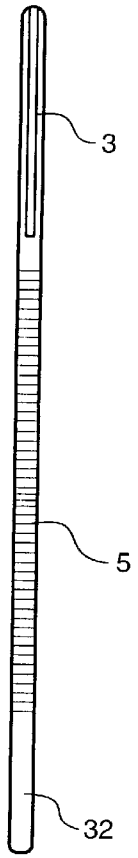
FIG. 11 is a top plan view of the body of the disposable straight razor shown in FIG. 9 and is taken along line 11—11 of FIG. 9.

FIG. 11 is a top plan view of the body 32 shown in FIG. 9 and is similar to the top plan view shown in FIG. 3 and shows the triple razor blade assembly 3 and the rough or serrated surface 5.

The straight razor 1, 21 or 31 can be made from different materials e.g., plastic, stainless steel, aluminum, wood etc. However, in one preferred embodiment of the straight razor of the present invention the body 7, 24 or 32 is made from plastic as it is cheap, light weight and easy to handle.

In the manufacture of the straight razor 1, 21 or 31, a mold having the required shape for the body 7, 24 or 32 is made and plastic is injected into the mold. It should be noted that injection of the plastic is made after first fixing the razor blade 3 to project out from an edge of the body 7, 24 or 32 to be molded by the distance specified above, namely 0.5 to 4 mm and preferably 1 to 2 mm. so that the razor 3 forms part of the one piece body 7, 24 or 32 whereby the razor blade 3 cannot be removed from the straight razor 1, 21 or 31.

Also, it will be noted that a user can use or place either side of the body 7, 24 or 32 adjacent the skin to be shaved and achieve a double shave, first by one of the outer blades 12 and then by the higher, middle blade 11.

From the foregoing description, it will be understood that the disposable straight razors 1, 21 or 31 of the present invention have a number of advantages, some of which have been described above and others of which are inherent in the invention.

Also, it will be understood that modifications can be made to the disposable straight razors 1, 21 or 31 of the present invention without departing from the teachings of the invention.

Accordingly, the scope of the invention is only to be limited as necessitated by the accompanying claims.

I claim:

1. A disposable straight razor comprising; an elongate thin body having spaced apart flat sides and opposite edges; a triple razor blade assembly mounted in said body and extending from one edge thereof; said body being molded about said triple razor blade assembly; said triple razor blade assembly comprises a higher, upper blade and two, outwardly spaced, lower, outer blades on either side of and spaced from said higher, upper blade, said triple razor blade assembly extending outwardly from said one edge of said body a distance of from approximately 0.5 mm to approximately 4 mm; and a cover for said body, said cover extending over said elongate body and completely over said triple razor blade assembly, said body being molded around said triple razor blade assembly to provide a one piece straight razor and said cover being a separate plastic cover.

2. The disposable straight razor of claim 1 wherein the upper edge of said upper blade is spaced above the upper edge of each one of said lower blades a distance of between approximately 0.5 mm and approximately 2 mm.

3. The disposable straight razor of claim 1 wherein said blades are spaced laterally from each other a distance of between approximately 0.5 mm and approximately 2 mm.

4. The disposable straight razor of claim 1 wherein said body is molded up to the upper edge of each lower, outer blade whereby said upper edge of each said lower blade is a smooth continuation of one side of said body.

5. The disposable straight razor of claim 1 wherein said body includes a handle portion having a curved free end.

6. The disposable straight razor of claim 1 wherein said body includes a handle portion having a free end in the shape of a ring for receiving a finger.

7. The disposable straight razor of claim 1 wherein said body includes a handle portion which has at least one curved finger or thumb-receiving notch on a side edge of said body mounting said razor blade assembly.

8. A disposable straight razor comprising: an elongate body; a triple razor blade assembly mounted in said body; said body being molded about said triple razor blade assembly; said triple razor blade assembly extending outwardly from said body a distance of from approximately 0.5 mm to approximately 4 mm; and a cover for said body, said cover extending over said body and completely over said triple razor blade assembly, said body including a handle portion and said cover being pivotally connected to said handle portion of said body and having an elongate slot with a width sufficient to cover said triple razor blade assembly and said body in which said triple razor blade assembly is mounted when said cover is pivoted over said body.

9. The disposable straight razor of claim 1 wherein the surface of said body has one of a rough texture or serrations to prevent sliding of said body in a hand of a user to provide for maximum control of the straight razor during use.

10. The disposable straight razor of claim 1 wherein said triple razor blade assembly projects out of said body a distance from approximately 1 mm to approximately 2 mm.

11. The disposable straight razor of claim 1 wherein said handle portion has a curved free end.

12. The disposable straight razor of claim 1 wherein said handle portion has a free end in the shape of a ring for receiving a finger.

13. The disposable straight razor of claim 1 wherein said handle portion has at least one curved finger or thumb receiving notch on a side edge of said body mounting said triple razor blade assembly.

14. A disposable straight razor comprising; an elongate body; a triple razor blade assembly mounted in said body; said body being molded about said triple razor blade assembly; said triple razor blade assembly extending outwardly from said body a distance of from approximately 0.5 mm to approximately 4 mm; a cover for said body, said cover extending over said body and completely over said triple razor blade assembly, said body being molded around said triple razor blade assembly to provide a one piece straight razor, and said cover being pivotally connected to said body and having a slot therein.

15. A disposable straight razor comprising: an elongate thin body having spaced apart flat sides and opposite edges; a triple razor blade assembly mounted in said body and extending from one edge thereof; said body being molded about said triple razor blade assembly; said triple razor blade assembly extending outwardly from said one edge of said body a distance of from approximately 0.5 mm to approximately 4 mm; and a cover for said body, said cover extending over said elongate body and completely over said triple razor, blade assembly.

16. The disposable straight razor of claim 15 wherein said triple razor blade assembly comprises a higher, upper blade, and two, outwardly spaced, lower, outer blades on either side of and spaced from said higher, upper blade.

17. The disposable straight razor of claim 16 wherein the upper edge of said upper blade is spaced above the upper edge of each one of said lower blades a distance of between approximately 0.5 mm and approximately 2 mm.

18. The disposable straight razor of claim 15 wherein said body includes a handle portion having a curved free end.

19. The disposable straight razor of claim 15 wherein said body includes a handle portion having a free end in the shape of a ring for receiving a finger.

20. The disposable straight razor of claim 15 wherein said body includes a handle portion which has at least one curved finger or thumb-receiving notch on a side edge of said body mounting said razor blade assembly.

* * * * *